US007438362B2

(12) United States Patent
Dotta et al.

(10) Patent No.: US 7,438,362 B2
(45) Date of Patent: Oct. 21, 2008

(54) DROP-IN SEAT UNIT

(75) Inventors: James C. Dotta, Arcadia, WI (US); Duane Olson, Arcadia, WI (US); Duane D. Herold, Arcadia, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 11/704,162

(22) Filed: Feb. 8, 2007

(65) Prior Publication Data

US 2007/0200416 A1 Aug. 30, 2007

Related U.S. Application Data

(60) Provisional application No. 60/771,849, filed on Feb. 8, 2006.

(51) Int. Cl.
*A47C 7/02* (2006.01)
*B21D 39/03* (2006.01)

(52) U.S. Cl. ..... 297/452.52; 297/463.2; 29/428

(58) Field of Classification Search ..... 297/452.52, 297/440.1, 452.49, 463.2, 463.1; 29/428; 267/110, 111; 53/396
See application file for complete search history.

(56) References Cited

U.S. PATENT DOCUMENTS 3,720,960 A 3/1973 Bond
3,744,846 A * 7/1973 Platt et al. ..... 297/452.52
3,971,082 A 7/1976 Crosby et al.
4,029,303 A 6/1977 Quakenbush
4,037,829 A 7/1977 Crosby et al.
4,055,865 A 11/1977 Crosby et al.
4,062,087 A 12/1977 Lingle
4,102,586 A 7/1978 Pearson et al.
4,124,201 A 11/1978 Burton
4,247,089 A 1/1981 Crosby et al.
4,364,547 A 12/1982 Crosby
4,586,700 A 5/1986 Crosby
4,815,717 A 3/1989 Crosby
5,188,343 A 2/1993 Galea
5,375,820 A 12/1994 Adams (Continued)

*Primary Examiner*—Milton Nelson, Jr.
(74) *Attorney, Agent, or Firm*—Patterson, Thuente, Skaar & Christensen, P.A.

(57) ABSTRACT

The present invention provides for a drop-in seat unit as well as a method of manufacturing the drop-in seat unit that does not require the worker to affix one end of the spring to a frame rail and stretch the spring from one of the frame rails to the other frame rail. The ends of the spring are affixed to the frame rails while the springs are in an un-stretched state. Once the plurality of springs is attached to the two frame rails, the rails are mechanically pulled away from each other, thus creating a larger open area between the frame rails and thus extending the springs. Once the rails are properly positioned in this extended state, support members are positioned between the two frame rails and one end of each support member is affixed to each frame rail, traversing the space or gap between the two frame rails. The support members fix the distance between the two frame rails. Once the springs are attached to the two frame rails and the support members are affixed to the two frame rails, the completed drop-in seat unit or seat box assembly is unclamped and released from the manufacturing apparatus and is ready for shipment or use in further construction of the sofa or chair.

17 Claims, 6 Drawing Sheets

U.S. PATENT DOCUMENTS

| | | | | |
|---|---|---|---|---|
| 5,409,198 | A | 4/1995 | Roick | |
| 5,538,325 | A | 7/1996 | Bullard | |
| 5,570,874 | A | 11/1996 | Tornero | |
| 5,615,869 | A | 4/1997 | Phillips et al. | |
| 6,264,179 | B1 | 7/2001 | Bullard | |
| 6,565,157 | B2 | 5/2003 | Barile, Jr. et al. | |
| 6,616,239 | B2 | 9/2003 | Guillot | |
| 6,942,298 | B2 * | 9/2005 | Harrison | 297/440.1 |
| 2003/0025256 | A1 | 2/2003 | Roick | |
| 2003/0052526 | A1 | 3/2003 | Crosby et al. | |
| 2003/0151293 | A1 | 8/2003 | McLarty et al. | |
| 2006/0170272 | A1 | 8/2006 | Mohn et al. | |

* cited by examiner 60
62
H
62
W
62
62
61
63
65
64
64
64

14
12
H 80
82
82
84
50
50
50
84

14
12
72
14
11
72

DROP-IN SEAT UNIT

RELATED APPLICATION

This application claims priority to U.S. Provisional Patent Application No. 60/771,849, filed Feb. 8, 2006, the disclosure of which is hereby incorporated by reference in its entirety.

FIELD OF THE INVENTION

The present invention relates to the field of furniture and furniture manufacture. In particular, the invention concerns the manufacture of drop-in seat units for use in the construction of sofas, couches, chairs and the like.

BACKGROUND OF THE INVENTION

Furniture such as sofas, couches, upholstered chairs and the like generally comprise a horizontal frame of metal or wood that delineates the base or seating area of the article, an upright section attached to the frame which supports the back, and two arm rests located on either end of the furniture article, to support the arms of a seated person. Cushions are generally positioned over the seating area and the upright section of the sofa or chair, to provide for padded and comfortable support for the seat and back of a person sitting on the sofa or chair.

Generally, the seat assembly of a sofa or chair includes a metal or wood seat box with a plurality of sinuous wires or springs, or coiled springs, extending across the frame, to provide support and flexibility for the seating area of the sofa or chair. Cushions or some other type of padding is placed upon the seating area to provide for a comfortable seat. The springs that extend across the frame of the seating area provide some "give" or flex to the seating area, such that the seating area can conform somewhat to the person seated on the sofa or chair.

The metal seat box of a sofa or chair generally includes four rails, with at least one pair of opposite rails containing a plurality of clips or hooks upon which the spring ends are attached. Generally, a spring end is affixed to a first rail of the drop-in seat box, the spring is extended, traversing the space between the first rail and the second rail which are parallel to one another, and the other spring end is affixed to the second (opposite) rail of the drop-in seat box. The spring ends are affixed to the drop-in seat box rails by way of a staple, hook or clip device. The extended springs are in a state of tension, as are the staples, clips or hooks holding the springs to the metal drop-in seat box.

Further, support devices or "seat stretchers" may be extended between the rails of the seat box assembly upon which the springs are affixed. Generally, the support devices are welded to the rails.

The above process of manufacturing the seat box for a sofa or chair is time-consuming since a number of parts must be assembled to construct the seat box, and construction may require certain expertise in assembly. Further, the handling and manufacture of the seat box as described can cause physical strain to the employees manufacturing the seat box.

SUMMARY OF THE INVENTION

According to the present disclosure, the structure and techniques for manufacturing a sofa or chair drop-in seat box are disclosed. The techniques and manufacturing processes utilized in manufacturing these sofa and/or chair drop-in seat units provide for the reduction of worker strain in the manufacturing process and increase output of drop-in seat units.

The present invention provides for a novel spring hook as well as a method of manufacturing the drop-in seat unit that does not require the worker to affix one end of the spring to a frame rail and stretch the spring from one of the frame rails to the other frame rail. The ends of the spring are affixed to the frame rails while the springs are in an unstretched state. Once the plurality of springs is attached to the two frame rails, the rails are mechanically pulled away from each other, thus created a larger open area between the frame rails and thus extending the springs. Once the rails are properly positioned in this extended state, support members are positioned between the two frame rails and one end of each support member is affixed to each frame rail, traversing the space or gap between the two frame rails. The support members fix the distance between the two frame rails. Once the springs are attached to the two frame rails and the support members are affixed to the two frame rails, the completed drop-in seat unit or seat box assembly is unclamped and released from the manufacturing apparatus and is ready for shipment or use in further construction of the sofa or chair.

The drop-in seat unit described above does not require any welding and uses few component parts. Further, the frame rails do not require end pieces on the frame rail ends. The support members that join the two frame rails can be displaced from the ends of the rails and provide support where desired.

DETAILED DESCRIPTION

The following description of the invention is provided using a sofa drop-in seat unit as one example or embodiment, however other embodiments, for example, a chair seat box, are contemplated. The invention may be embodied in different forms and should not be construed as limited to the embodiments provided herein.

Figure 1:
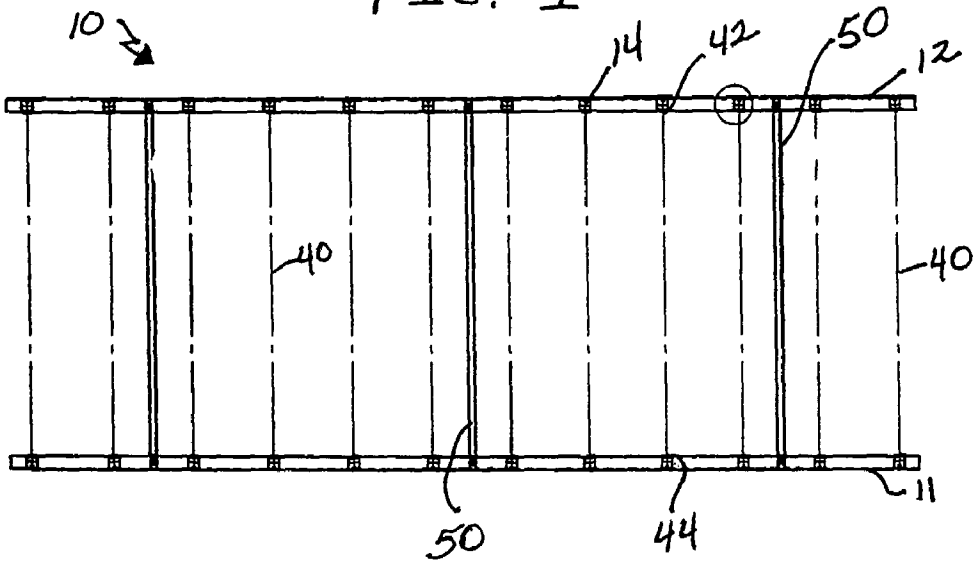
FIG. 1 is a top view of a completed drop-in seat unit.
Figures 2, 2A, 2B, 2C:
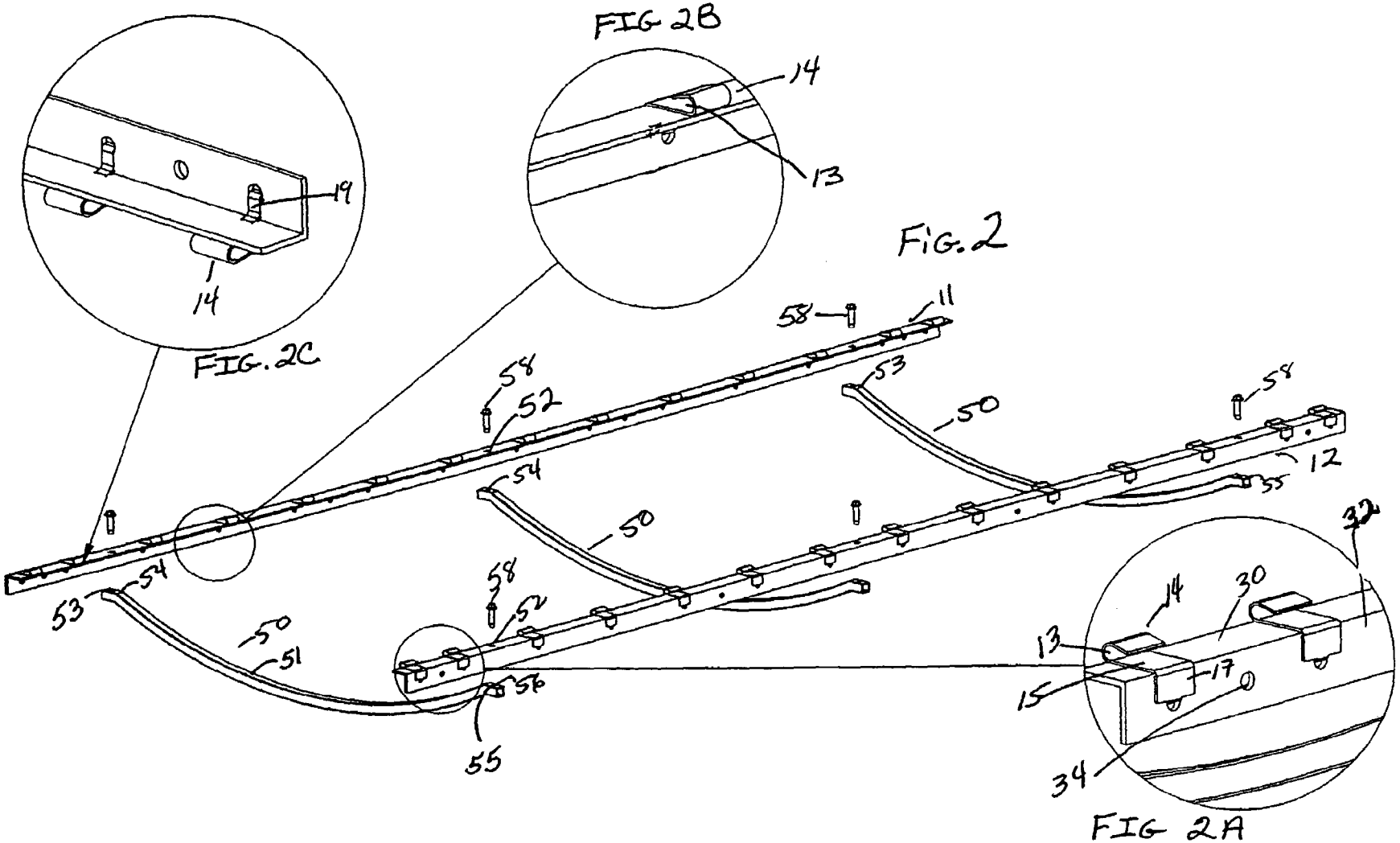
FIG. 2 is an perspective and exploded view of a partially completed drop-in seat unit.
FIG. 2A is a close-up perspective view of a frame rail with hooks attached.
FIG. 2B is a close-up perspective view of a hook affixed to a frame rail.
FIG. 2C is a close-up perspective view of the interior side of a frame rail with a hook in place, showing the hook attachment.

Referring to FIG. 1, there is provided a completed sofa drop-in seat unit or seat box assembly 10. The drop-in seat unit 10 comprises frame rails 11, 12, hooks 14, springs 40, and support members 50. In one embodiment, the frame rails 11, 12 are generally L-shaped with one frame rail leg 30 positioned perpendicularly to the second frame rail leg 32, as noted in FIG. 2A. Additional frame rail configurations and hook attachments are contemplated. Frame rail leg 32 further includes apertures 34 adapted to receive one end of the hook 14. The hook body segment 15 of the hook 14 lies along the surface of frame rail leg 30.

Figure 3:
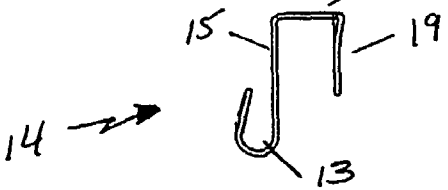
FIG. 3 is a side view of a hook.
Figure 7:
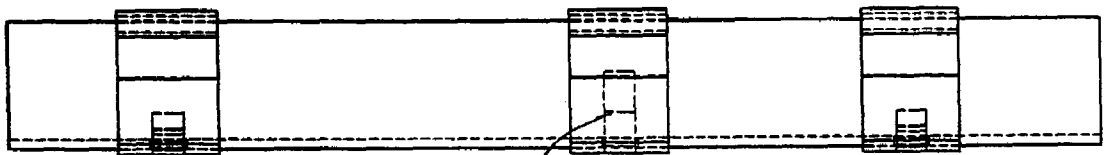
FIG. 7 is a top view of hooks affixed to a frame rail.
Figure 8:
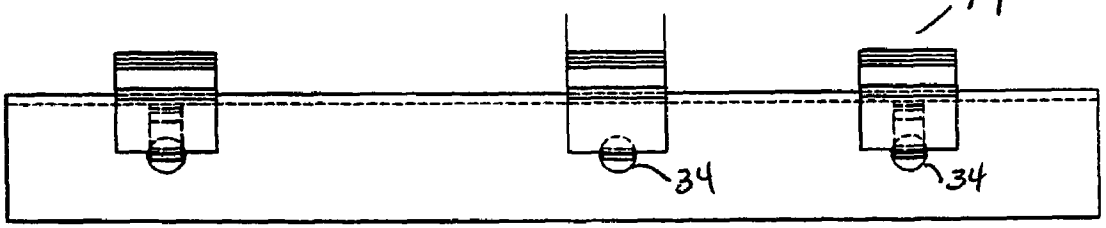
FIG. 8 is a side view of hooks affixed to a frame rail.

FIG. 3 provides further detail of the shape of the hook 14. One end of the hook 14 is curved, curving back upon itself to form the receiving slot 13 for one of spring ends 42, 44. The horizontally extending hook body segment 15 of the hook 14 then bends at approximately 90 degrees (90°), forming a vertical segment 17 of the hook, perpendicular to hook body segment 15. The vertical hook segment 17 bends again at approximately 90 degrees (90°) in a horizontal direction, parallel and opposite to hook body segment 15, forming hook end segment 19. Hook body segment 15 and hook end segment 19 are generally parallel to one another.

Figure 5:
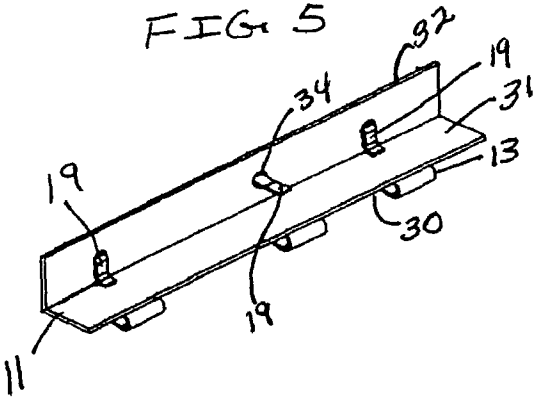
FIG. 5 is a perspective view of a hook affixed to a frame rail.
Figure 4:
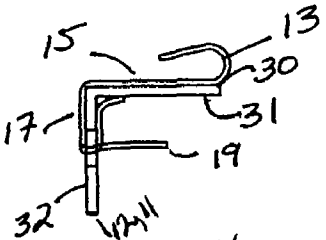
FIG. 4 is a side view of a hook affixed to a frame rail.

FIG. 4 demonstrates the position of hook 14 as it is affixed to a frame rail 11, 12. The hook body segment 15 is disposed adjacent frame rail leg 30, in a horizontal position, such that the hook receiving slot 13 is oriented upward, positioned to receive a spring end 42, 44. The hook vertical segment 17 is disposed adjacent frame rail leg 32. Hook end segment 19 extends through an aperture 34 in the frame rail leg 32, and bends towards frame rail leg 30, on the interior of the frame rail 11, 12. Bending hook segment 19 towards frame rail leg 30 secures hook 14 in place and to the frame rail 11, 12. Hence, the hooks 14 can be affixed to the frame rails 11, 12 in a pre-assembly operation and can be shipped to a furniture manufacturer without loss of hooks 14 from the frame rail 11, 12 or damage to the hooks 14. As shown in FIG. 5, hook 14 is affixed to frame rail 11 (affixed identically to frame rail 12) by inserting hook end segment 19 through aperture 34, and then bending hook end segment 19 towards frame rail leg 30. A plurality of hooks 14 are affixed to the two frame rails 11, 12 such that when the two frame rails 11, 12 are aligned in parallel to each other, the hooks 14 on first frame rail 11 are also aligned in parallel to the hooks 14 affixed to the second frame rail 12.

Figure 6:
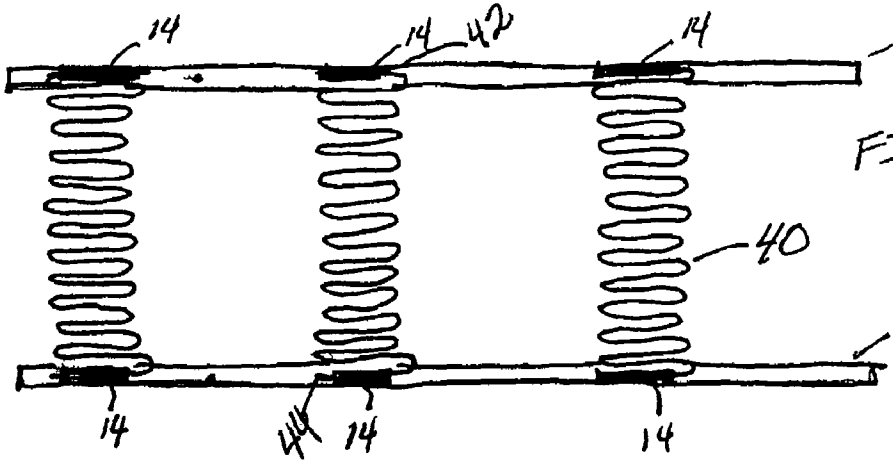
FIG. 6 is a top view of sinusoidal springs affixed to the two frame rails through the hook.

FIG. 6 shows a plurality of sinusoidal springs 40 that are extended between the two frame rails 11, 12. Other shaped springs may also be used and are within the scope of the invention. Sinusoidal spring 40 contains two spring ends 42, 44. The spring ends 42, 44, are affixed to hooks 14 that have been affixed to the frame rails 11, 12. The frame rails 11, 12 are oriented in parallel to one another, such that the hooks 14 affixed to the first frame rail 11 are oriented in parallel to the hooks 14 affixed to the second frame rail 12. Sinusoidal spring end 42 is disposed in receiving slot 13 of hook 14, wherein hook 14 is affixed to first frame rail 11, and sinusoidal spring end 44 is disposed in receiving slot 13 of hook 14, wherein hook 14 is affixed to second frame rail 12. The position of the attached sinusoidal springs 40 relative to the rail frames 11, 12 is shown in FIGS. 1 and 6.

In addition to the plurality of sinusoidal springs 40 extended between the first frame rail 11 and the second frame rail 12, there is a plurality of support members 50 also extended between the first frame rail 11 and the second frame rail 12. The support members 50 are generally arcuate, and are positioned among the sinusoidal springs 40 that are affixed to the frame rails 11, 12. Alternatively, the support members 50 may be other-shaped, such as straight shaped, instead of arcuate. Further, alternatively, the support members 50 may be positioned at the ends of the frame rails 11, 12, extending between the first frame rail 11 and the second frame rail 12. In another embodiment, support members 50 may be positioned at the ends of the frame rails 11, 12, and other support members 50 may be positioned among the sinusoidal springs 40 that are affixed to the frame rails 11, 12. The arcuate shape of the support members 50 provides strength to the drop-in seat unit and the seat. The support members 50 can be of various shaped tubing, but preferably are comprised of square tubing. FIG. 1 shows one embodiment of the frame rails 11, 12, with the sinusoidal springs 40 and the arcuate support members 50 affixed to the frame rails 11, 12.

Figure 9:
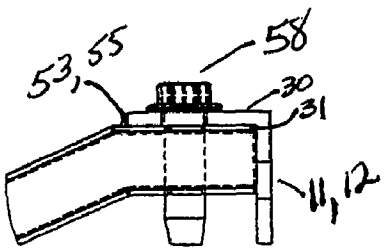
FIG. 9 is a side view of a support member affixed to a frame rail.
Figure 11:
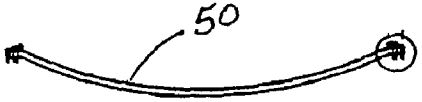
FIG. 11 is a side view of a support member.

The frame rails 11, 12 have a plurality of apertures 52 in frame rail leg 30, wherein the apertures 52 are adapted to receive a bolt 58, or other mechanical attachment device, such as a screw, pin, nail, or the like. The arcuate support member 50 has an aperture 54, 56 disposed at each end 53, 55 of the arcuate support member 50. The aperture 54, 56 is also adapted to receive a bolt 58. The arcuate support member 50 extends between the frame rails 11, 12, connecting the first frame rail 11 to the second frame rail 12. As shown in FIG. 9, the support member end 53 is positioned such that the top surface 51 of the support member end 53 abuts frame rail surface 31, in the interior of the L-shape of the first frame rail 11. The aperture 52 in the first frame rail 11 is aligned with the aperture 54 in the support member 50 and the bolt 58 is inserted through both apertures 52, 54 and secured. Bolt 58 can be a self-tapping bolt.

Similarly, the support member end 55 is positioned such that the top surface 51 of the support member end 55 abuts frame rail surface 31, in the interior of the L-shape of the second frame rail 12. The aperture 52 in the second frame rail 12 is aligned with the aperture 56 in the support member 50 and the bolt 58 is inserted through both apertures 52, 56 and secured. The completed drop-in seat unit comprises the frame rails 11, 12; the hooks 14; the sinusoidal springs 40, and the support members 50 which are affixed to the frame rails 11, 12 by way of bolts 58.

Method of Assembly

Figure 10:
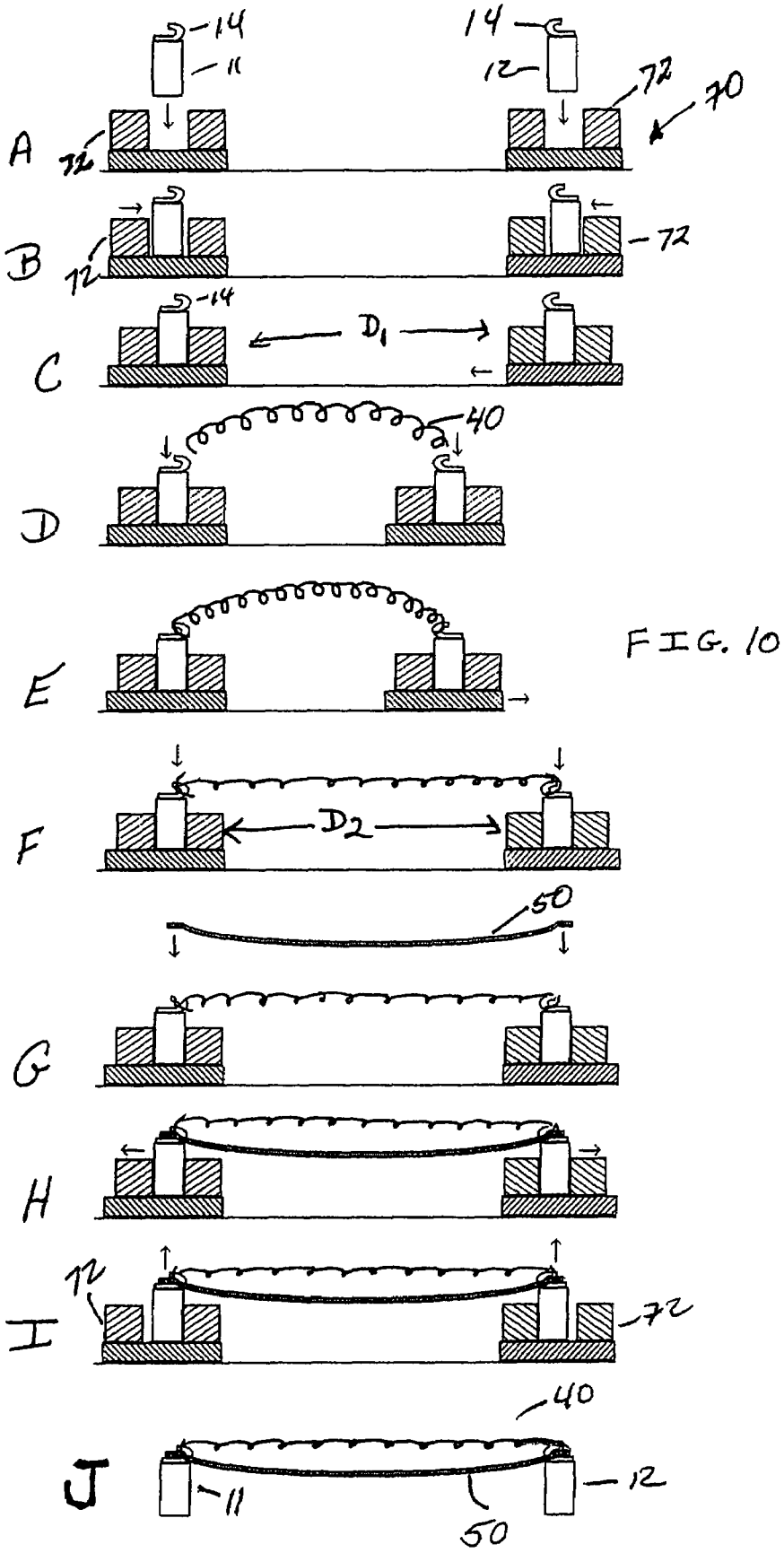
FIG. 10 is a step diagram showing the basic structure fixing steps in the drop-in seat unit assembly production process.
Figures 13, 13A, 13B, 14:
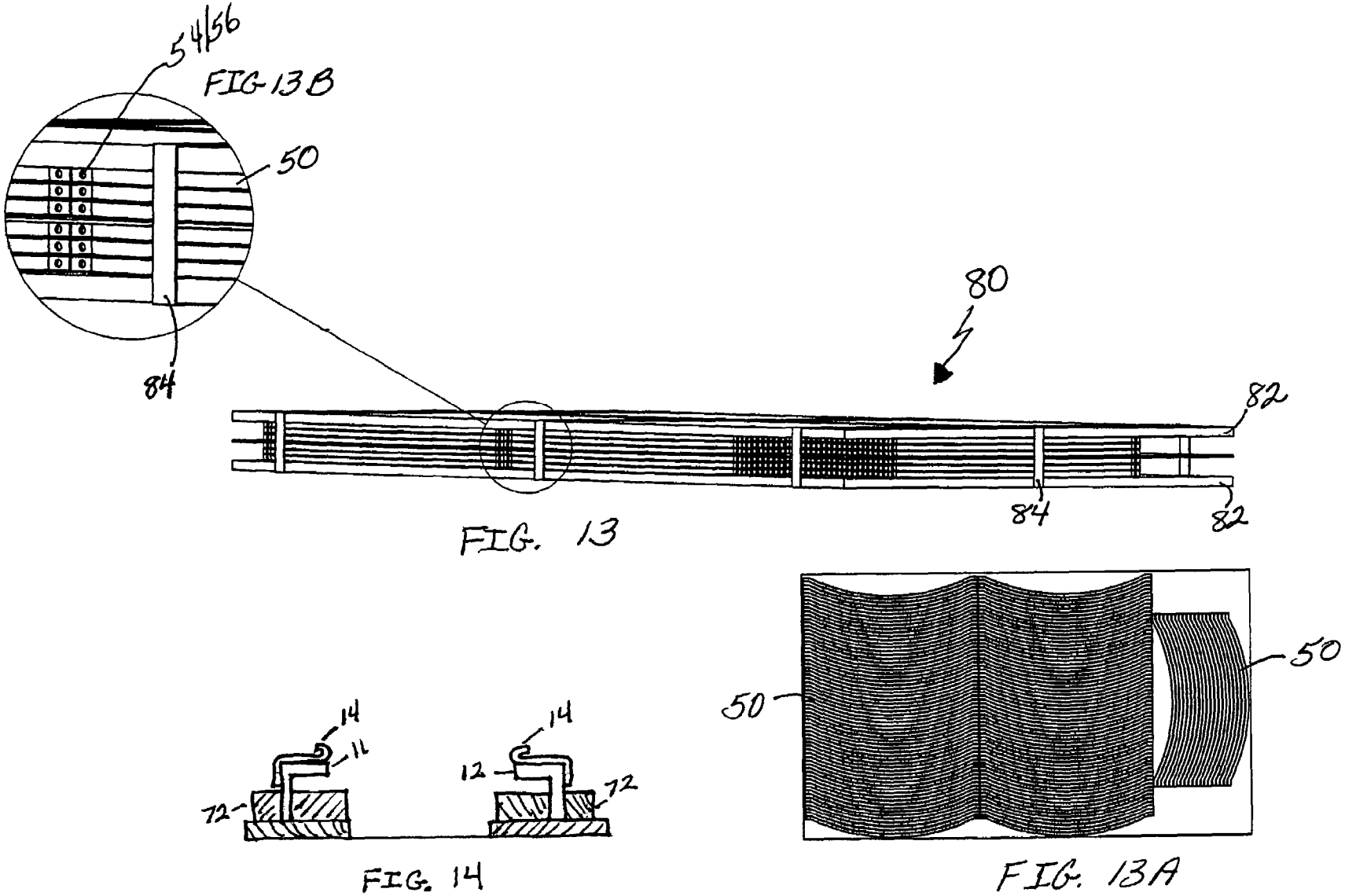
FIG. 13 is a side view of the packed stacked support members.
FIG. 13A is a top plan view of the stacked support members.
FIG. 13B is a close-up view of the stacked support members.
FIG. 14 is a side view of an embodiment of the frame rails in the assembly production process.

The drop-in seat unit is assembled in a series of steps. The hooks 14 are affixed to the frame rails 11, 12 by placing the hook body segment 15 along the frame rail leg 30 and inserting the hook end segment 19 through an aperture 34 in the frame rail leg 32, and bending the hook end segment 19 towards frame surface 31, on the interior of the frame rail 11, 12. A plurality of hooks 14 is affixed to first frame rail 11 and a plurality of hooks is affixed to second frame rail 12 in this manner. As shown in FIG. 10, the frame rails 11, 12 are positioned in an apparatus 70 wherein the first frame rail 11 is clamped 72 in one section of the apparatus 70 and the second frame rail 12 is clamped 72 in another section of the apparatus 70. The blocks representing the frame rails 11, 12, of FIG. 10 are representative of the frame rails; L-shaped frame rails or frame rails of another shape. FIG. 14 depicts L-shaped rails 11, 12 clamped 72 in apparatus 70. The frame rails 11, 12 are clamped in parallel position to each other with a distance $D_1$ between the frame rails 11, 12. The frame rails 11, 12 are positioned in the apparatus such that the hooks 14 are positioned on the top surface of the frame rails 11, 12.

Once the frame rails 11, 12 are each clamped 72 in place, a plurality of sinusoidal springs 40 are affixed to the frame rails 11, 12. A first end 42 of a sinusoidal spring 40 is inserted in receiving slot 13 of hook 14 on one of the frame rails, e.g. first frame rail 11. Then a similar action is repeated with the other end of the sinusoidal spring 40 in the other frame rail, e.g. frame rail 12. A second end 44 of the sinusoidal spring 40 is inserted in the receiving slot 13 of the hook 14 on the second frame rail 12. Hence, one end 42 of sinusoidal spring 40 is affixed to the first frame rail 11 and the other end 44 of the sinusoidal spring 40 is affixed to the second frame rail 12, thereby connecting the two frame rails.

After the plurality of sinusoidal springs 40 is attached to the two frame rails 11, 12 and tapped in place, the apparatus 70 is adjusted to increase the distance D ($D_2$) between the first frame rail 11 and the second frame rail 12. Hence, the distance $D_2$ is greater than the distance $D_1$. The increase in distance between the frame rails 11, 12 causes tension to be added to the sinusoidal springs 40 and for the sinusoidal springs 40 to elongate. When the frame rails 11, 12 are moved to a predetermined separation distance $D_2$, then the arcuate support members 50 are added to the drop-in seat unit 10.

A plurality of arcuate support members 50 is affixed between the first frame rail 11 and the second frame rail 12, bridging the gap between the frame rails 11, 12. The top surface 51 of support end 53 is disposed adjacent first frame rail 11 surface 31, such that top surface 51 of support end 53 abuts first frame rail 11 surface 31. The aperture 54 in support end 53 is aligned with aperture 52 in first frame rail 11, and a bolt 58, preferably a self-tapping bolt 58, is inserted into the aligned apertures 52, 54 and fixed. Further, the other end of the support member 50, support end 55, is disposed adjacent second frame rail 12 surface 31, such that top surface 51 of support end 55 abuts second frame rail 12 surface 31. The aperture 56 in support end 55 is aligned with aperture 52 in second frame rail 12, and a bolt 58, preferably a self-tapping bolt 58, is inserted into the aligned apertures 52, 56 and fixed. In each instance, the support end 53, 55 is positioned in the interior of the L formed by the two surfaces of the frame rail 11, 12. It is understood that the position of the support member is reversible, such that support end 53 can be affixed to second frame rail 12 and support end 55 can be affixed to first frame rail 11.

Once the arcuate support members 55 are affixed to the frame rails 11, 12, then the apparatus is adjusted such that the clamping devices 72 holding the frame rails 11, 12 in place are released, and the frame rails 11, 12 are no longer gripped in the apparatus. The completed drop-in seat unit (seat box assembly) is removed from the apparatus and the cycle can begin again with the placement of a first frame rail 11 and a second frame rail 12 in the apparatus 70 and clamping 72 of the frame rails 11, 12 in place.

The method described above allows a worker to construct the drop-in seat unit 10 without the worker having to stretch the sinusoidal springs 40 to be able to attach the sinusoidal springs 40 to the frame rails 11, 12 after the frame rails 11, 12 are properly spaced apart. Instead, the apparatus 70 provides the force to separate the frame rails 11, 12 to the appropriate spacing ($D_2$) after the sinusoidal springs 40 have been attached to the frame rails 11, 12. Further, no welding is required in the manufacture of the drop-in seat unit.

Figures 12, 12A:
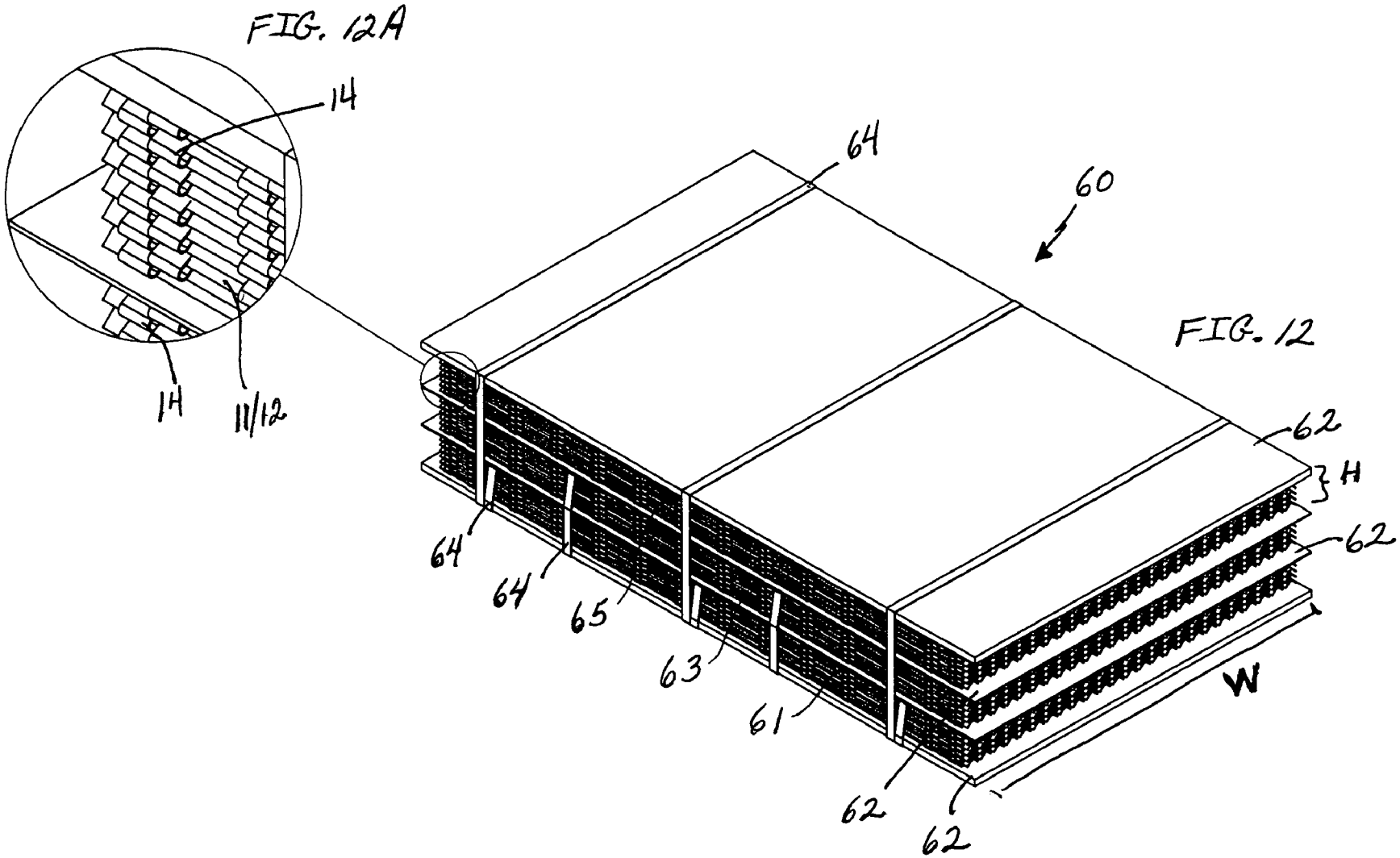
FIG. 12 is a top perspective view of the packaged stacked pre-assembled frame rails.
FIG. 12A is a close-up perspective view of the stacked pre-assembled frame rails, showing the offset hooks.

Pre-assembled frame rails may be easily nested for stacking, storage or shipping, as shown in FIG. 12. The pre-assembled frame rails 11, 12 include the hooks 14 already affixed to the frame rails 11, 12. The hooks 14 can be affixed to the frame rails 11, 12 by the manufacturer of the frame rails 11, 12, a job shop or some other party. The pre-assembled frame rails 11, 12 are stacked for shipping as shown in FIG. 12. The pre-assembled frame rails 11, 12 are stacked offset to allow for the hooks 14, which are fixed to the frame rails 11, 12. FIG. 12A demonstrates the offset position of the hooks 14 on the stacked frame rails 11, 12, such that the hooks 14 do not interfere with one another and allow for compact nesting of the pre-assembled frame rails 11, 12. The hooks 14 are affixed to the frame rails 11, 12, as described above, such that the hooks 14 are "locked" to the frame rails 11, 12. With the hooks 14 locked onto the frame rails 11, 12, the pre-assembled frame rails 11, 12 can be stacked and transported without the loss of hooks 14 and without a need to use resources to replace missing hooks 14.

The pre-assembled frame rails 11, 12 can be stacked in various heights and widths, however a preferred configuration is described below. The number of pre-assembled frame rails in the stacks can be varied and still fall within the scope and spirit of the patent. The pre-assembled frame rails 11, 12 are stacked in three tiers, wherein each tier contains 25 pre-assembled frame rails across the width (W) and 12 pre-assembled frame rails 11, 12 in height (H). A dunnage board 62 is placed under the first tier 61, and the first tier 61 of pre-assembled frame rails 11, 12 is stacked on the dunnage board 62. A second dunnage board 62 is placed on the first tier 61 of pre-assembled frame rails 11, 12. A second tier 63 of pre-assembled frame rails 11, 12 is placed on the dunnage board 62, in the same configuration as the first tier 61 of pre-assembled frame rails 11, 12. Another dunnage board 62 is placed on top of the second tier 63 of the pre-assembled frame rails 11, 12. A third tier 65 of pre-assembled frame rails 11, 12 is placed on top of the third dunnage board 62. The third tier 65 of pre-assembled frame rails 11, 12 is configured similarly to the first and second tiers of pre-assembled frame rails 11, 12. A fourth dunnage board 62 is placed on top of the third tier 65 of pre-assembled frame rails 11, 12, and forms the top of the frame rail unit 60.

The dunnage board 62 that is utilized in packing the pre-assembled frame rails 11, 12 is made from MDF, plywood, OSB material and the like. Further, the dunnage board 62 must be at least 16 mm thick or thicker. The frame rail unit 60 is banded in between the tiers as shown in FIG. 12. Banding the frame rail unit 60 in-between the dunnage boards 62 assists in preventing the pre-assembled frame rails 11, 12 from shifting during transport. Further, the configuration of the bands 64 is conducive to banding a tier, stacking another tier, and banding together those tiers, and so on. The bands 64 are made from corrugated tie sheets and the like. Further, the entire frame rail unit 60 is banded with bands 64 extending around the top and the bottom dunnage boards 62. Prior to shipping, the entire frame rail unit 60 is stretch wrapped. The configuration of the frame rail unit 60 provides a compact method of transporting the pre-assembled frame rails 11, 12 such that there is minimal damage to the pre-assembled frame rails 11, 12 and the hooks 14 are not displaced due to stacking and remain affixed during transport. Further, the configuration of the frame rail unit 60 also allows for stacking of frame rail units 60 for transport.

The support members 50 can also be compactly stacked for transport. The number of support members in the stacks can be varied and still fall within the scope and spirit of the patent, however, a preferred configuration is provided below. The support members 50 can be arranged horizontally and stacked on top of each other in vertical stacks of 65 support members, with two such stacks of support members 50 positioned end to end. FIG. 13A shows the position of the two stacks of 65 support members each. An additional 20 support members 50 are stacked and oriented vertically to the side of the two stacks of 65 support members 50. FIG. 13A shows the orientation of the two stacks of 65 support members 50 and the one stack of 20 support members 50 to each other.

FIG. 13B provides a close-up of the orientation of the support members 50 in the packed configuration. The two stacks of 65 support members 50 are oriented horizontally, along with the stack of 20 support members 50. Three such groupings are stacked one on top of the other on a bottom dunnage board 82. A dunnage board 82 is placed on top of this arrangement of 450 support members (3 layers of 130; 3 layers of 20). Then another 450 support members 50 are arranged in the same configuration on top of the dunnage board 82. A dunnage board 82 is placed on top of this layer of support members 50, and the support member unit 80 is banded. FIG. 13 shows the orientation of the support member 50 in the packed configuration, with the dunnage boards 82 and bands 84 in place.

The dunnage boards 82 used are made from material such as MDF, plywood OSB material and the like. The dunnage board 82 is preferably 16 mm thick or thicker. The bands 84 are preferably corrugated tie sheets. Once the support member unit 80 is compiled, preferably 6 layers of 150 support members 50, and banded, the entire support member unit 80 is stretch wrapped for transport. The use of the dunnage board 82 provides a number of benefits, including protecting the support members 50, keeping the support members 50 from shifting during transport, and being able to stack the support member units 80.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

We claim:

1. A drop-in seat unit comprising:

a two frame rail drop-in seat unit frame comprising a first frame rail and a second frame rail, wherein the first frame rail and the second frame rail are spaced-apart. each frame rail comprising a first leg and a second leg, wherein the first leg is substantially perpendicular to the second leg, thus forming an L-shape, and wherein the first leg of the first frame rail and the first leg of the second frame rail extend horizontally, the second leg defining a plurality of apertures adapted to receive the end of a hook;

a plurality of first hooks fixed to the first frame rail and a plurality of second hooks fixed to the second frame rail, wherein each hook comprises a straight hook end, a hook body, and a hook receiving slot, the straight hook end of each hook extending into one of the apertures in the second leg of one of the frame rails, the hook body disposed adjacent the first leg with the hook receiving slot facing upward the straight hook end being bent towards the second leg to lock the hook onto the frame rail;

a plurality of springs, each having a first end attached to one of the first hooks and a second end attached to one of the second hooks; and a plurality of support members each having a first end affixed to the first frame rail and a second end affixed to the second frame rail.

2. The drop-in seat unit of claim 1 wherein the first frame rail and the second frame rail are substantially parallel to each other.

3. The drop-in seat unit of claim 1 wherein the springs are sinusoidal and un-stretched.

4. The drop-in seat unit of claim 1 wherein the hooks on the first frame rail are aligned with the hooks on the second frame rail.

5. The drop-in seat unit of claim 1 wherein the support members affixed to the first frame rail and the second frame rail are interposed among the springs which are sinusoidal, and that are attached to the first frame rail and the second frame rail.

6. A drop-in seat unit comprising:

a two frame rail drop-in seat unit frame comprising a first frame rail and a second frame rail, wherein the first frame rail and the second frame rail are spaced-apart, each frame rail comprising a first leg and a second leg, wherein the first leg is substantially perpendicular to the second leg, thus forming an L-shape, and wherein the first leg of the first frame rail and the first leg of the second frame rail extend horizontally, the first leg of each frame rail defining a plurality of apertures adapted to receive a securing device selected from the group consisting of a bolt, a screw, a self-tapping bolt, a pin, and a nail, the apertures in the first frame rail first leg being aligned substantially opposite to the apertures of the second frame rail first leg;

a plurality of first hooks fixed to the first frame rail and a plurality of second hooks fixed to the second frame rail, wherein each hook comprises a straight hook end, a hook body, and a hook receiving slot, and wherein the straight hook end has been bent such that each hook is locked onto the frame rail;

a plurality of springs, each having a first end attached to one of the first hooks and a second end attached to one of the second hooks; and a plurality of support members each having a first end affixed to the first frame rail and a second end affixed to the second frame rail wherein an aperture in a first end of each is aligned with one of the apertures in the first frame rail first leg, and a second end of each support member is aligned with one of the apertures in the second frame rail first leg, such that the support member is fitted in the L-shape between the first leg and the second leg in an interior of the frame rail, a securing device affixing the support member first end to the first frame rail first leg, and a securing device securing the support member second end to the second frame rail first leg.

7. The drop-in seat unit of claim 6 wherein the support members are arcuate.

8. A method of assembling a drop-in seat unit comprising the steps of:

placing a first L-shaped frame rail and a second L-shaped frame rail in frame rail holders of a drop-in seat unit assembly apparatus, wherein the first frame rail is substantially parallel to the second frame rail, and wherein each frame rail comprises a plurality of hooks;

affixing a plurality of un-stretched springs between the first frame rail and the second frame rail, wherein one end of each spring is affixed to a first hook in the first frame rail and a second end of each spring is affixed to a second hook in the second frame rail;

increasing the distance between the first frame rail and the second frame rail by pulling apart frame rail holders of the drop-in seat unit apparatus to a predetermined distance, thereby stretching the springs;

affixing a plurality of support members between the first frame rail and the second frame rail, wherein one end of a support member is affixed to the first frame rail and a second end of the support member is affixed to the second frame rail; and releasing the frame rails from the frame rail holders of the drop-in seat unit apparatus, wherein a completed drop-in seat unit is removable from the drop-in seat unit apparatus.

9. The method of claim 8 further comprising the step of affixing a plurality of hooks to the first frame rail and a plurality of hooks to the second frame rail, wherein a hook end is inserted into an aperture in a vertical surface of the frame rail and bent to secure the hook to the frame rail and wherein a hook body is disposed adjacent a horizontal surface of the frame rail, such that a receiving slot in the hook is upward facing.

10. The method of claim 8 wherein the springs are sinuous springs.

11. The method of claim 8 wherein the support members are arcuate.

12. The method of claim 8 wherein the hooks in the first frame rail are substantially aligned opposite the hooks in the second frame rail.

13. The method of claim 8 further comprising aligning an aperture in one end of the support member with an aperture in a horizontal surface of the first frame rail and aligning an aperture in the second end of the support member with an aperture in a horizontal surface of the second frame rail and affixing the support member to the first frame rail and the second frame rail with a securing device.

14. The method of claim 13 wherein the securing device is chosen from the group comprising a screw, a bolt, a selftapping bolt, a pin and a nail.

15. A method of packing a support member unit comprising:

stacking a plurality of support members, one on top of the other;

arranging a first stack of support members and a second stack of support members, end to end;

placing the first stack of support members and the second stack of support members on a dunnage board, such that the two stacks are oriented in a horizontal position;

arranging a third smaller stack of support members to one side of the first stack or the second stack of support members such that the third stack of support members is oriented in a horizontal position and positioned substantially perpendicularly or at 90 degrees to the first or second stack of support members, thus forming a layer of stacked support members;

arranging a plurality of similar layers of support members on top of a first layer of support members;

placing a dunnage board on top of a top layer of support members;

placing a plurality of similar layers of support members on top of the dunnage board;

placing a dunnage board on top of the top layer of support members; and banding the support member unit with bands, the bands extending from the bottom dunnage board to the top dunnage board.

16. A method of packing a pre-assembled frame rail unit comprising:

stacking a plurality of pre-assembled frame rails on a first dunnage board, such that hooks fixed to the pre-assembled frame rails are off-set from one another;

arranging a plurality of stacks of pre-assembled frame rails horizontally, such that one stack of pre-assembled frame rails abuts a length of another stack of pre-assembled frame rails, to a width of stacked pre-assembled frame rails on the first dunnage board, thus forming a first layer of pre-assembled frame rails;

placing a second dunnage board on top of the layer of pre-assembled frame rails;

arranging a second layer of pre-assembled frame rails on top of the second dunnage board;

placing a third dunnage board on top of the layer of pre-assembled frame rails;

arranging a third layer of pre-assembled frame rails on top of the third dunnage board;

placing a fourth dunnage board on top of the layer of pre-assembled frame rails; and banding the pre-assembled frame rail unit with a plurality of bands.

17. The method of claim 16 wherein a first set of bands extends from the first dunnage board to the top of the first layer of pre-assembled frame rails, a second set of bands extends from the first dunnage board to the top of the second layer of pre-assembled frame rails;

and a third set of bands extends from the first dunnage board to the top of the fourth dunnage board.

* * * * *